US006724289B2

(12) United States Patent
Moga et al.

(10) Patent No.: US 6,724,289 B2
(45) Date of Patent: Apr. 20, 2004

(54) IGNITION APPARATUS HAVING FEATURE FOR SHIELDING THE HV TERMINAL

(75) Inventors: Viorel N. Moga, Anderson, IN (US); James Patrick Henry, Noblesville, IN (US); Rick E. Funkhouser, Munice, IN (US)

(73) Assignee: Delphi Technologies, Inc., Troy, MI (US)

( * ) Notice: Subject to any disclaimer, the term of this patent is extended or adjusted under 35 U.S.C. 154(b) by 212 days.

(21) Appl. No.: 09/932,267

(22) Filed: Aug. 17, 2001

(65) Prior Publication Data

US 2003/0034865 A1 Feb. 20, 2003

(51) Int. Cl.[7] ..... H01F 27/02

(52) U.S. Cl. ..... 336/90; 336/107; 336/192; 123/634

(58) Field of Search ..... 336/65, 90, 92, 336/96, 107, 192, 198; 123/634, 635

(56) References Cited

U.S. PATENT DOCUMENTS 5,714,922 A 2/1998 Suzuki et al. ..... 336/107
6,023,215 A * 2/2000 Sakamaki et al. ..... 336/96
6,094,121 A 7/2000 Sakamaki et al. ..... 336/96
6,208,231 B1 * 3/2001 Oosuka et al. ..... 336/107

FOREIGN PATENT DOCUMENTS

EP 0837481 4/1998

* cited by examiner

*Primary Examiner*—Tuyen T. Nguyen
(74) *Attorney, Agent, or Firm*—Jimmy L. Funke

(57) ABSTRACT

An ignition apparatus includes a high voltage (HV) terminal formed of stamped sheet metal configured to be disposed in a secondary winding spool, and to which a high voltage end of the secondary winding is attached and soldered. The ignition apparatus further includes an electrically conductive cup configured to surround the high voltage terminal when the secondary winding spool is inserted in the case. The high voltage terminal has one end that comes into engagement with an inner annular surface of the cup. The cup includes an annular sidewall that extends axially up to a winding flange where a HV end of the secondary winding exits a winding bay thereby surrunding the exiting HV secondary winding wire. The cup provides for a reduced electric field concentration.

11 Claims, 2 Drawing Sheets

IGNITION APPARATUS HAVING FEATURE FOR SHIELDING THE HV TERMINAL

BACKGROUND OF THE INVENTION

1. Technical Field

The present invention relates generally to an ignition apparatus for developing a spark firing voltage that is applied to one or more spark plugs of an internal combustion engine.

2. Discussion of the Background Art

Ignition coils are known for use in connection with an internal combustion engine such as an automobile engine, and which include a primary winding, a secondary winding, and a magnetic circuit. The magnetic circuit conventionally may comprise a cylindrical-shaped, central core extending along an axis, located radially inwardly of the primary and secondary windings and magnetically coupled thereto. The components are contained in a case formed of electrical insulating material, with an outer core or shield located outside of the case. One end of the secondary winding is conventionally configured to produce a relatively high voltage when a primary current through the primary winding is interrupted. In a common configuration, insulating resin or the like is introduced into the gap between the secondary winding and the case for insulating purposes. The high voltage end is coupled to a spark plug, as known, that is arranged to generate a discharge spark responsive to the high voltage. It is further known to provide relatively slender ignition coil configuration that is adapted for mounting directly above the spark plug—commonly referred to as a "pencil" coil.

One problem in the design of ignition coils, particularly pencil coils, involves a relatively high electrical field concentration at a location where the high voltage end of the secondary winding is terminated to a high voltage (HV) secondary terminal associated to a secondary winding spool. The relatively high electrical field concentration may be magnified by any burr, sharp edge, or solder icicle that may be formed on the terminal.

In addition, to connect the high voltage end of the secondary winding to the HV secondary terminal, the wire end must leave a so-called winding bay (i.e., the winding surface on the spool between upper and lower flanges). Outside the winding bay, the secondary winding wire creates a high density electric field therearound. As a consequence, the increased electrical field concentration, over time, may result in an electrical tree or dendrite forming off of the secondary winding, which may propagate through the insulating resin. After the dendrite grows far enough, for example toward ground potential (i.e., through the resin and case to the shield), the high voltage secondary winding will short to ground and the ignition coil will fail.

U.S. Pat. No. 6,208,231 issued to Oosuka et al. entitled "STICK-TYPE IGNITION COIL HAVING IMPROVED STRUCTURE AGAINST CRACK OR DIELECTRIC DISCHARGE," discloses an ignition coil wherein a high voltage end of the secondary coil is electrically connected to a dummy coil, which is then electrically connected to a terminal plate. A high voltage connector configured for connection to a spark plug is then connected to the terminal plate. Oosuka et al. disclose the contention that since the secondary coil and the terminal plate are electrically connected through not a single connection but rather through the dummy coil, the surface area of the electrically connected portion between the secondary coil and the terminal plate is enlarged so as to avoid the concentration of electrical field. However, Oosuka et al. still disclose that the high voltage end of the dummy coil is electrically connected to the terminal plate by fusing or soldering. Additionally, the secondary winding wire as it leaves the winding bay still presents a relatively thin profile, wherein a high electric field is maintained. Accordingly, it is believed that the same problems described above continue to exist in the design of Oosuka et al.

Accordingly, there is a need for an improved ignition apparatus that minimizes or eliminates one or more of the problems as set forth above.

SUMMARY OF THE INVENTION

An object of the present invention is to solve one or more of the problems as set forth above. An ignition apparatus according to the present invention overcomes shortcomings of conventional ignition apparatus by including an electrically conductive cup absent of sharp edges, burrs, or the like, which makes contact with a portion of a high voltage terminal. The cup also surrounds the high voltage terminal and the secondary winding wire as it exits the winding bay (i.e., it extends, in an axial direction, up to a lower winding flange). Because the cup is at the same voltage potential as the high voltage terminal, there will not be an electric field concentration in and around the area of the high voltage terminal. Additionally, since the cup extends up to the winding flange, the secondary connection wire is also surrounded, reducing the electric field in that region. The reduction in electric field concentration reduces or eliminates formation of dendrites which, as described in the Background, may over time result in ignition coil failures.

An ignition apparatus according to the present invention comprises a central core having a main axis, and primary and secondary windings outwardly of the central core. The secondary winding is wound on a secondary winding spool having a winding surface and at least one flange. The flange is provided to cooperate with the winding surface to receive the secondary winding. A high voltage end of the secondary winding is connected to a high voltage terminal located away from the winding surface. According to the invention, a cup formed of metal material engages the high voltage terminal on an inner surface thereof. The cup is configured to be contacted by a connector assembly that is itself suitable for connection to a spark plug. The cup surrounds the HV terminal, and, significantly, extends axially up to the winding flange also surrounding the secondary winding wire as it exits the winding surface. The cup being free of sharp edges and the like, as well as surrounding the secondary winding wire, reduces electrical field concentrations.

A method of making an ignition apparatus including the aforementioned conductive cup is also presented.

BRIEF DESCRIPTION OF THE DRAWINGS

The present invention will now be described by way of example, with reference to the accompanying drawings.

DETAILED DESCRIPTION OF THE PREFERRED EMBODIMENTS

Figure 1:
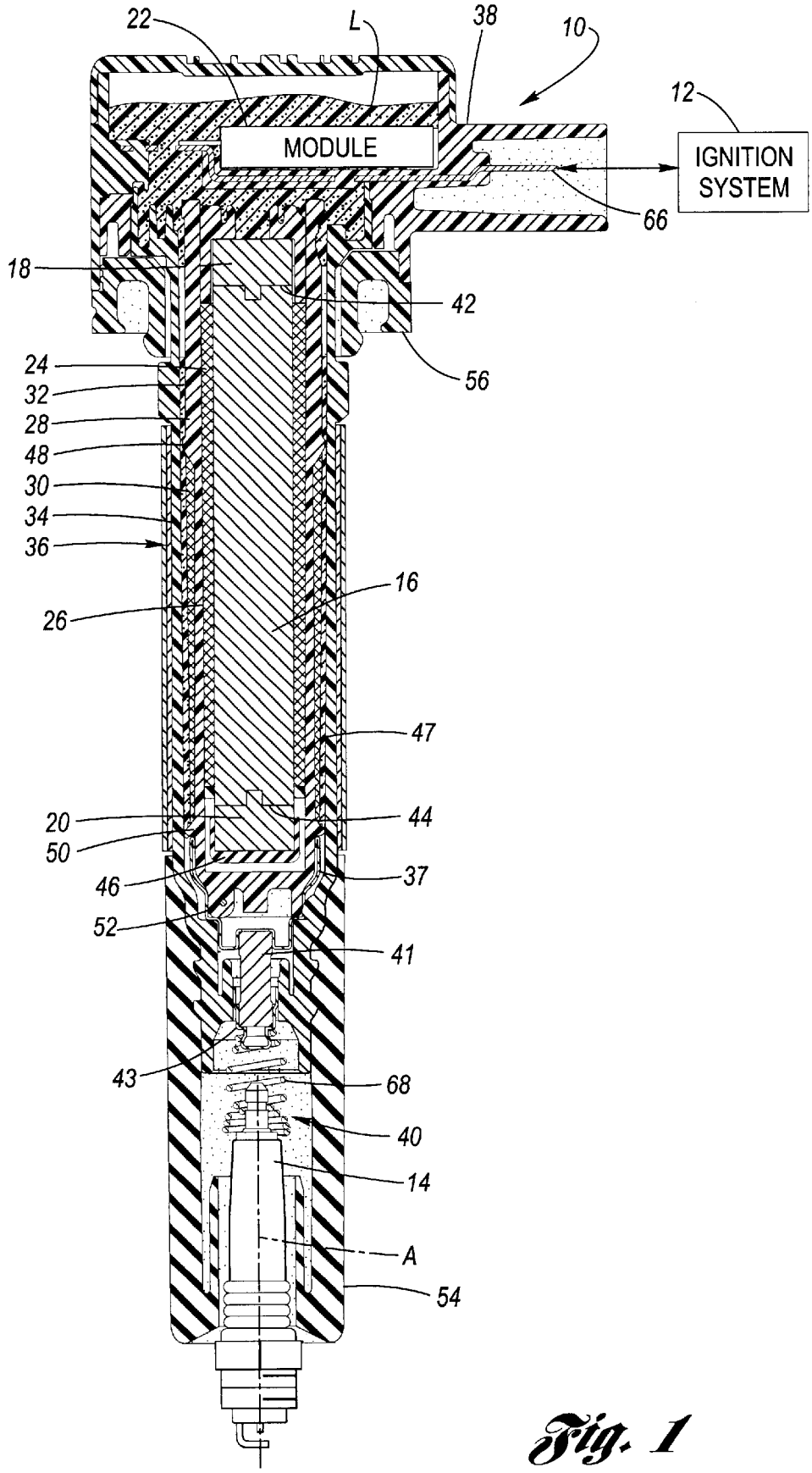
FIG. 1 is a simplified cross-sectional view of an ignition apparatus having a conductive cup high voltage terminal arrangement according to the present invention.

Referring now to the drawings wherein like reference numerals are used to identify identical components in the various views, FIG. 1 is a simplified, cross-section view of an ignition apparatus or coil 10 in accordance with the present invention. As is generally known, ignition apparatus 10 may be coupled to, for example, an ignition system 12, which contains primary energization circuitry for controlling the charging and discharging of ignition apparatus 10. Further, the relatively high voltage produced by ignition apparatus 10 is provided to a spark plug 14 for producing a spark across a spark gap thereof, which may be employed to initiate combustion in a combustion chamber of an engine. Ignition system 12 and spark plug 14 perform conventional functions well known to those of ordinary skill in the art.

Ignition apparatus 10 is adapted for installation to a conventional internal combustion engine through a spark plug well onto a high-voltage terminal of spark plug 14, which may be retained by a threaded engagement with a spark plug opening into the above-described combustion cylinder. The engine may provide power for locomotion of a self-propelled vehicle, such as an automotive vehicle.

FIG. 1 further shows a core 16, an optional first magnet 18, an optional second magnet 20, an electrical module 22, a primary winding 24, a first layer of encapsulant such as an epoxy potting material layer 26, a secondary winding spool 28, a secondary winding 30, a second layer 32 of encapsulant such as epoxy potting material, a case 34, a shield assembly 36, a first electrically conductive cup 37, a low-voltage (LV) connector body 38, and a high-voltage (HV) connector assembly 40. Core 16 includes a top end 42 and a bottom end 44. Connector assembly 40 may include an inductive resistor 41, a second conductive cup 43, and a spring 68. FIG. 1 further shows a rubber buffer cup 46, a winding surface 47 of spool 28, annular flange portions 48, 50, a high voltage (HV) secondary terminal 52, a boot 54, and a seal member 56.

As described in the Background, a significant failure mode for conventional pencil coils results from a high electric field intensity where the high voltage end of the secondary winding is brought out of the winding bay and routed to the HV secondary terminal. Over time, with such conventional arrangements, dendrites form, and grow through the insulating epoxy and case toward ground potential (e.g., toward the shield element). Once the insulating resin and/or case material has been compromised, the high voltage secondary winding can short to ground, thus failing the ignition coil.

Conductive cup 37 is made so as to not have sharp edges, burrs, or the like. The cup is in electrical contact with the high voltage terminal, and is therefore at the same electrical potential or voltage. Significantly, the cup has annular sidewalls that extend axially up to the lower winding flange 50. Accordingly, the aforementioned electric field concentration is reduced relative to the prior art.

Figure 2:
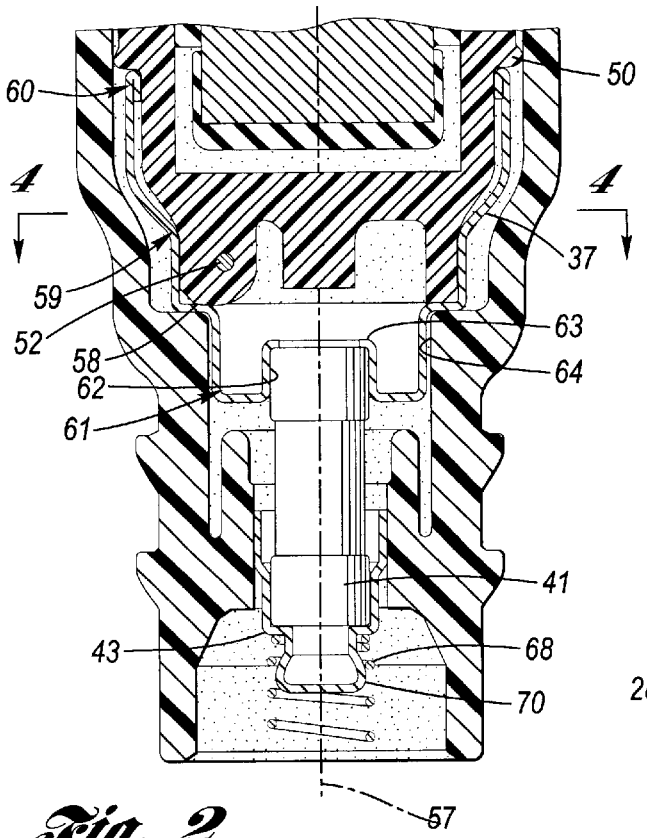
FIG. 2 is a simplified cross-sectional view showing a portion of the cup of FIG. 1.

FIG. 2 shows a portion of FIG. 1 containing cup 37 in greater detail. The HV terminal 52 may be of the conventional stamped sheet metal type (e.g., 1008 steel) that is associated with secondary spool 28, and to which a high voltage end of secondary winding 30 is terminated.

Cup 37, generally, is configured in size and shape to be pressed or molded onto a lower axial portion of spool 28. Cup 37 is manufactured in such a way so as to not have any sharp edges, burrs, or the like. These manufacturing approaches include but are not limited to machining and stamping, coupled with, for example, a vibratory finishing.

Cup 37 has a longitudinal axis associated therewith and is generally annular in shape. Cup 37 further includes a base 58, and a first, generally annular side wall 59 extending therefrom in a first axial direction to a folded over (hemmed) edge 60 that defines an opening leading to an interior of the cup. The interior is configured to receive a lower longitudinal end of secondary winding spool 28. The lower end of spool 28 is configured to receive the high voltage terminal 52. The interior is defined, in-part, by an inner, generally annular surface of sidewall 59. The axial extent of sidewall 59 is such that it extends all the way up to flange 50 when cup 37 is placed on spool 28 (so that base 58 engages spool 28).

Cup 37 further includes a second annular side wall 61 extending from base 58 in a second axial direction opposite the first axial direction. In the illustrated embodiment, cup 37 includes an annular aperture 62 having a stop surface 63. Aperture 62 is configured in size and shape to receive an end of resistor 41 in a press fit (interference fit).

Significantly, however, cup 37 is formed out of stamped sheet metal, which is subjected to a drawing and forming operation to arrive at the result shown in FIGS. 1–4. Fold 60 exhibits a relatively large radii, so as to maintain a reduced electric field (i.e., eliminate sharp edges). In addition, since sidewall 59 extends up to flange 50, the cup surrounds the secondary winding 30 as it exits winding surface 47. Cup 37 may be formed out of aluminum, brass, or other suitable electrically conductive material.

Figure 3:
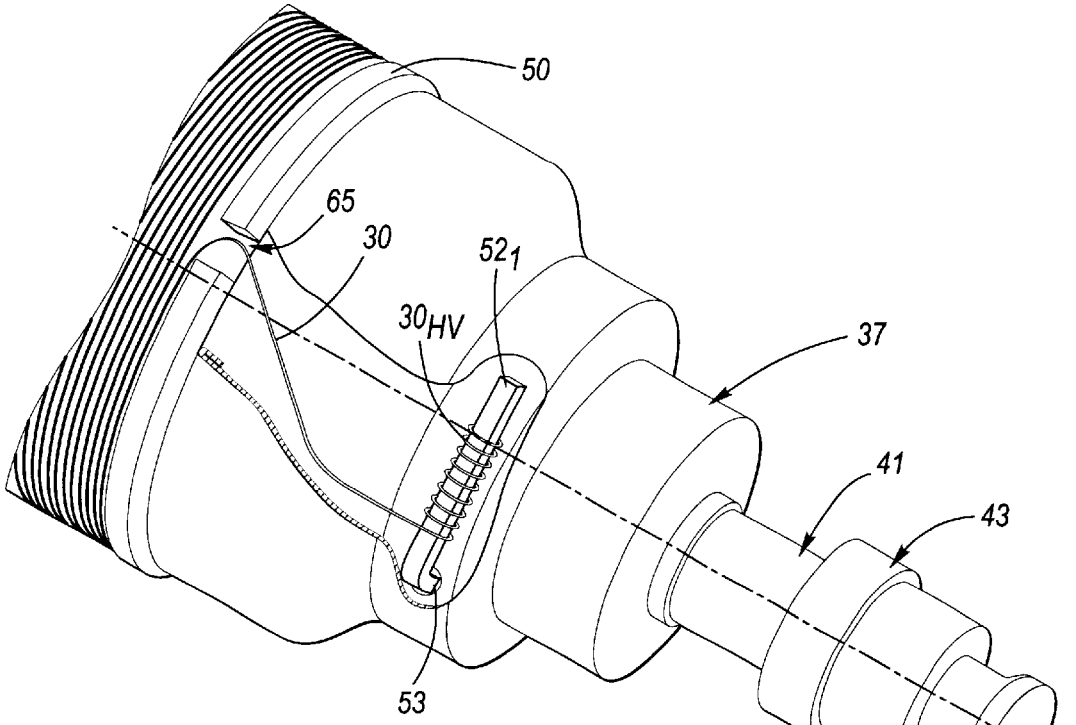
FIG. 3 is a simplified perspective view of the apparatus of FIG. 1, with portions broken away, showing a connection to a HV terminal.

FIG. 3 is a perspective of ignition apparatus 10, with portions broken away. Secondary winding 30 exits the winding bay through an axially extending passage 65. In the illustrated embodiment, terminal 52 comprises a wire that is square shaped in cross-sectional. Terminal 52 is inserted in a bore 53 formed in spool 28. A high voltage end of winding 30, designated $\mathbf{30}_{HV}$, is terminated on end $\mathbf{52}_1$ of terminal 52, for example, via multiple turns, accompanied by a conventional soldering process.

Figure 4:
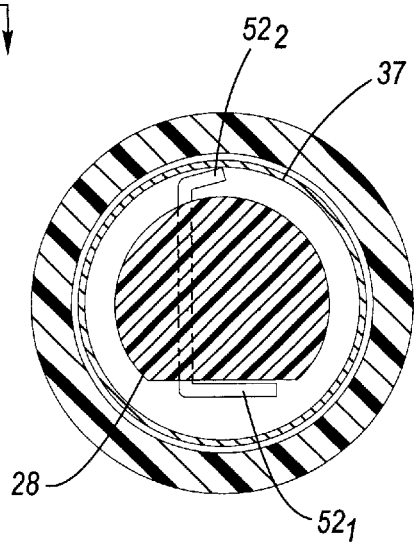
FIG. 4 is a simplified cross-sectional view taken substantially along lines 4—4 in FIG. 3 showing the HV terminal contacting the conductive cup.

With reference to FIG. 4, when secondary spool 28 is inserted and pressed longitudinally downwardly into case 34, terminal 52 will go down into an interior portion of cup 37. A first end $\mathbf{52}_1$, is bent over after the high voltage end $\mathbf{30}_{HV}$ is terminated thereto. The second end $\mathbf{52}_2$ is also bent over; however, the shape and dimensions of spool 28 and cup 37 are selected so that end $\mathbf{52}_2$ engages cup 37 when cup 37 is placed over the bottom of spool 28. The shape of spool 28 and dimensions are further selected so that end $\mathbf{52}_1$ does not touch cup 37. Terminal end $\mathbf{52}_2$ and cup 37 will be in positive electrical contact. Because cup 37 is at substantially the same voltage potential as high voltage terminal 52, and cup 37 surrounds terminal 52, there will be a substantially reduced or eliminated electric field concentration at terminal 52. Moreover, since cup 37 has sidewalls 59 that extend axially up to flange 50 (best shown in FIGS. 2–3), the wire exiting the secondary winding bay is also surrounded. This has the advantage of reducing the concentrated electric field surrounding the thin wire.

As to additional advantages, solder tips and sharp edges that are present at the point where the secondary winding is terminated (e.g., end $\mathbf{52}_1$), and which arise due to conventional manufacturing processes can now be tolerated. In addition, the design of an ignition apparatus according to the invention will also be robust as to the bend position of terminal $\mathbf{52}_1$, so that the position of terminal $\mathbf{52}_1$ will now not have to be as controlled. In conventional arrangements, if high voltage terminal end $\mathbf{52}_1$ were not bent over far enough, the radially outermost portions thereof would be closer to case 34, and would result in a higher electric field. As to cost advantages, an ignition apparatus according to the invention is less expensive to manufacture since certain manufacturing equipment can be eliminated, such as (i) that required to eliminate sharp solder points, (ii) that needed to measure the HV terminal bend position. Finally, in an internal combustion engine environment, the reduced electric field will result in lower ignition apparatus failures, and accordingly a lower warranty return rate. These improvements result by the substantial reduction or elimination of case punch-through failures (i.e., dendrite growth through insulating resin material, through case material, to ground potential, namely, the outer core or shield). The reduced electric field concentration will also extend the service life of the ignition apparatus.

Referring again to FIG. 1, further details concerning ignition apparatus 10 will now be set forth configured to enable one to practice the present invention. It should be understood that portions of the following are exemplary only and not limiting in nature. Many other configurations are known to those of ordinary skill in the art and are consistent with the teachings of the present invention. Central core 16 may be elongated, having a main, longitudinal axis "A" associated therewith. Core 16 includes an upper, first end 42, and a lower, second end 44. Core 16 may be a conventional core known to those of ordinary skill in the art. As illustrated, core 16, in the preferred embodiment, takes a generally cylindrical shape (which is a generally circular shape in radial cross-section), and may comprise compression molded insulated iron particles or laminated steel plates, both as known.

Magnets 18 and 20 may be optionally included in ignition apparatus 10 as part of the magnetic circuit, and provide a magnetic bias for improved performance. The construction of magnets such as magnets 18 and 20, as well as their use and effect on performance, is well understood by those of ordinary skill in the art. It should be understood that magnets 18 and 20 are optional in ignition apparatus 10, and may be omitted, albeit with a reduced level of performance, which may be acceptable, depending on performance requirements.

A rubber buffer cup 46 may be included.

Module 22 may be configured to perform a switching function, such as connecting and disconnecting an end of primary winding to ground.

Primary winding 24 may be wound directly onto core 16 in a manner known in the art. Primary winding 24 includes first and second ends and is configured to carry a primary current $I_P$ for charging apparatus 10 upon control of ignition system 12 of module 22. Winding 24 may be implemented using known approaches and conventional materials. Although not shown, primary winding 24 may be wound on a primary winding spool (not shown) in certain circumstances (e.g., when steel laminations are used). In addition, winding 24 may be wound on an electrically insulating layer that is itself disposed directly on core 16.

Layers 26 and 32 comprise an encapsulant suitable for providing electrical insulation within ignition apparatus 10. In a preferred embodiment, the encapsulant comprises epoxy potting material. The epoxy potting material introduced in layers 26, and 32 may be introduced into annular potting channels defined (i) between primary winding 24 and secondary winding spool 28, and, (ii) between secondary winding 30 and case 34. The potting channels are filled with potting material, in the illustrated embodiment, up to approximately the level designated "L" in FIG. 1. In one embodiment, layer 26 may be between about 0.1 mm and 1.0 mm thick. Of course, a variety of other thicknesses are possible depending on flow characteristics and insulating characteristics of the encapsulant and the design of the coil 10. The potting material also provides protection from environmental factors which may be encountered during the service life of ignition apparatus 10. There is a number of suitable epoxy potting materials well known to those of ordinary skill in the art.

Secondary winding spool 28 is configured to receive and retain secondary winding 30. In addition to the features described above, spool 28 is further characterized as follows. Spool 28 is disposed adjacent to and radially outwardly of the central components comprising core 16, primary winding 24, and epoxy potting layer 26, and, preferably, is in coaxial relationship therewith. Spool 28 may comprise any one of a number of conventional spool configurations known to those of ordinary skill in the art. In the illustrated embodiment, spool 28 is configured to receive one continuous secondary winding (e.g., progressive winding) on an outer winding surface thereof, between upper and lower flanges 48 and 50 ("winding bay"), as is known. However, it should be understood that other configurations may be employed, such as, for example only, a configuration adapted for use with a segmented winding strategy (e.g., a spool of the type having a plurality of axially spaced ribs forming a plurality of channels therebetween for accepting windings) as known.

The depth of the secondary winding in the illustrated embodiment may decrease from the top of spool 28 (i.e., near the upper end 42 of core 16), to the other end of spool 28 (i.e., near the lower end 44) by way of a progressive gradual flare of the spool body. The result of the flare or taper is to increase the radial distance (i.e., taken with respect to axis "A") between primary winding 24 and secondary winding 30, progressively, from the top to the bottom. As is known in the art, the voltage gradient in the axial direction, which increases toward the spark plug end (i.e., high voltage end) of the secondary winding, may require increased dielectric insulation between the secondary and primary windings, and, may be provided for by way of the progressively increased separation between the secondary and primary windings.

Spool 28 is formed generally of electrical insulating material having properties suitable for use in a relatively high temperature environment. For example, spool 28 may comprise plastic material such as PPO/PS (e.g., NORYL available from General Electric) or polybutylene terephthalate (PBT) thermoplastic polyester. It should be understood that there are a variety of alternative materials that may be used for spool 28 known to those of ordinary skill in the ignition art, the foregoing being exemplary only and not limiting in nature.

Features 48 and 50 may be further configured so as to engage an inner surface of case 34 to locate, align, and center the spool 28 in the cavity of case 34 and providing upper and lower defining features for a winding surface therebetween.

As described above, spool 28 has associated therewith an electrically conductive (i.e., metal) high-voltage (HV) terminal 52 disposed therein configured to engage cup 37, which cup is in turn electrically connected to the HV connector assembly 40. The body of spool 28 at a lower end thereof is configured so as to be press-fit into the interior of cup 37 (i.e., the spool gate portion).

FIG. 1 also shows secondary winding 30 in cross-section. Secondary winding 30, as described above, is wound on spool 28, and includes a low voltage end and a high voltage end $\mathbf{30}_{HV}$. The low voltage end may be connected to ground by way of a ground connection through LV connector body 38 in a manner known to those of ordinary skill in the art. The high voltage end $\mathbf{30}_{HV}$ is connected to HV terminal 52 as shown in FIG. 3. Winding 30 may be implemented using conventional approaches and material known to those of ordinary skill in the art.

Case 34 includes an inner, generally enlarged cylindrical surface, an outer surface, a first annular shoulder, a flange, an upper through-bore, and a lower through bore.

The inner surface of case 34 is configured in size to receive and retain spool 28 which contains the core 16 and primary winding 24. The inner surface of case 34 may be slightly spaced from spool 28, particularly the annular features 48, 50 thereof (as shown), or may engage the features 48, 50.

Lower through-bore 64 (best shown in FIG. 2) is defined by an inner surface thereof configured in size and shape (i.e., generally cylindrical) to accommodate an outer surface of cup 37 at a lowermost portion thereof as described above. When the lowermost body portion of spool 28 is inserted in the lower bore containing cup 37, a portion of HV terminal $\mathbf{52}_2$ engages an inner surface of cup 37 (also via a press fit) as best shown in FIG. 4.

Case 34 is formed of electrical insulating material, and may comprise conventional materials known to those of ordinary skill in the art (e.g., the PBT thermoplastic polyester material referred to above).

Shield 36 is generally annular in shape and is disposed radially outwardly of case 34, and, preferably, engages an outer surface of case 34. The shield 36 preferably comprises electrically conductive material, and, more preferably metal, such as silicon steel or other adequate magnetic material. Shield 36 provides not only a protective barrier for ignition apparatus 10 generally, but, further, provides a magnetic path for the magnetic circuit portion of ignition apparatus 10. Shield 36 may be grounded by way of an internal grounding strap, finger or the like (not shown) well know to those of ordinary skill in the art. Shield 36 may comprise multiple, individual sheets 36, as shown.

Low voltage connector body 38 via module 22 is configured to, among other things, electrically connect the first and second ends of primary winding 24 to an energization source, such as, the energization circuitry (e.g., power source) included in ignition system 12. Connector body 38 is generally formed of electrical insulating material, but also includes a plurality of electrically conductive output terminals 66 (e.g., pins for ground, primary winding leads, etc.). Terminals 66 are coupled electrically, internally through connector body 38 to module 22 and other portions of apparatus 10, in a manner known to those of ordinary skill in the art.

HV connector assembly 40 is provided for establishing an electrical connection to spark plug 14. Assembly 40 may include an inductive resistor 41, a second conductive cup 43 and a spring contact 68 or the like. Resistor 41 may be provided to combat electromagnetic interference (EMI). Second cup 43 provides for a transition spring 68. Cup 43 includes an annular projection 70 configured allow spring 68 to be coupled thereto. Contact spring 68 is in turn configured to engage in a high-voltage connector terminal of spark plug 14. This arrangement for coupling the high voltage developed by secondary winding 30 to plug 14 is exemplary only; a number of alternative connector arrangements, particularly spring-biased arrangements, are known in the art.

An ignition apparatus in accordance with the present in invention includes a conductive cup used in establishing a high voltage connection between the secondary winding/HV terminal and the spark plug (perhaps via additional components such as resistor 41, cup 43 and via spring 68) which significantly reduces the electric field intensity in the area of the connection. Particularly, the cup 37 has a sidewall that extends axially up to the flange. This extension surrounds the HV end portion of secondary winding 30 as it leaves the winding bay, which is operative to reduce the electric field concentration. The reduction in the electric field intensity substantially minimizes or eliminates a significant failure mode for pencil ignition coils, namely, the grounding out of the secondary winding through an arcing via a dendrite formed in the insulating material (e.g., to a ground such as the outer core or shield). This reduction of the occurrence of this failure mode leads to lower warranty returns, as well as increasing the product's expected service life.

What is claimed is:

1. An ignition apparatus comprising:

a central core having a main axis;

a primary winding;

a spool having a winding surface and a flange;

a terminal;

a secondary winding wound on said surface and having a high-voltage end thereof connected to said terminal; and a cup formed of metal material engaging said terminal and configured to be contacted by a connector assembly for connection to a spark plug, wherein said cup defines a first cup having a base and a generally annular side wall, said side wall extending from said base to said spool flange in a generally axial direction relative to said main axis, said side wall having an interior surface facing said spool and terminal, said interior surface of said first cup engaging said terminal;

said connector assembly including a second conductive cup, a resistive element between said first cup and said second cup, and a spring coupled to said second cup.

2. The apparatus of claim 1 wherein said resistive element comprises a ceramic resistor, said spring being configured to be connected to the spark plug.

3. The apparatus of claim 1 wherein said flange extends radially outwardly relative to said winding surface, said flange including an axially extending passage configured to allow said high voltage end of said secondary winding to pass therethrough to said terminal.

4. The apparatus of claim 1 wherein said sidewall is a first side wall and said axial direction is a first axial direction, said cup having a second annular side wall extending from said base in a second axial direction opposite said first axial direction, said second annular side wall terminating in a closed end of said cup.

5. The apparatus of claim 4 wherein said first annular wall has a first diameter associated therewith and said second annular side wall has a second diameter associated therewith smaller than said first diameter.

6. The apparatus of claim 1 wherein said up comprises one of aluminum, brass material, and steel.

7. The apparatus of claim 1 wherein said cup is configured to surround said terminal and said high voltage end of said secondary winding.

8. The apparatus of claim 1 wherein said cup is formed of stamped sheet metal, a fold region defined at an end of said first annular wall.

9. The apparatus of claim 1 wherein said terminal is configured to present a resilient arrangement for engaging an inner surface of said cup.

10. An ignition coil comprising:

a central core formed of magnetically permeable material having a main axis;

a primary winding disposed radially outwardly of said core;

a secondary winding spool having a winding surface and a flange;

a high-voltage terminal;

a secondary winding wound on said surface and having a high-voltage end thereof connected to said high-voltage terminal;

a case formed of electrical insulating material disposed outwardly of said core, said spool and said primary and secondary windings;

an outer core formed of magnetically permeable material located radially outwardly of said case; and a cup formed of metal contacting said high-voltage terminal configured to be contacted by a connector assembly for connection to a spark plug, wherein said cup has a base and a generally annular side wall extending radially along said main axis around said terminal and extending axially to said flange thereby providing an interior surface to engage said terminal.

11. The apparatus of claim 10 wherein said flange includes at least one axially extending passage for allowing said high-voltage end of said secondary winding to pass therethrough for connection to said terminal.

* * * * *